US006655029B2

(12) United States Patent
Saito

(10) Patent No.: US 6,655,029 B2
(45) **Date of Patent: *Dec. 2, 2003**

(54) SAFETY RAZOR

(75) Inventor: Tatsuya Saito, Seki (JP)

(73) Assignee: Kai R & D Center Co., Ltd., Gifu (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 48 days.

(21) Appl. No.: 09/281,652

(22) Filed: Mar. 30, 1999

(65) Prior Publication Data

US 2001/0054235 A1 Dec. 27, 2001

(30) Foreign Application Priority Data

Mar. 30, 1998 (JP) ..... 10-099858

(51) Int. Cl.[7] ..... B26B 21/40
(52) U.S. Cl. ..... 30/50; 30/55; 30/77
(58) Field of Search ..... 30/50, 51, 55, 30/77, 78, 81, 79, 346.5, 346.57

(56) References Cited

U.S. PATENT DOCUMENTS

| | | | | | |
|---|---|---|---|---|---|
| 969,226 | A | * | 9/1910 | Warner | 30/79 |
| 3,675,325 | A | * | 7/1972 | Michelson | 30/90 |
| 4,914,817 | A | * | 4/1990 | Galligan et al. | 30/77 |
| 5,063,668 | A | * | 11/1991 | Althaus | 30/50 |
| 5,305,526 | A | * | 4/1994 | Althaus | 30/77 |
| 5,410,812 | A | * | 5/1995 | Althaus | 30/50 |
| 5,456,009 | A | * | 10/1995 | Wexler | 30/50 |
| 5,493,778 | A | * | 2/1996 | Ichiyanagi | 30/50 |
| 5,560,105 | A | * | 10/1996 | Ichiyanagi | 30/50 |
| 5,666,729 | A | * | 9/1997 | Ferraro | 30/50 |

FOREIGN PATENT DOCUMENTS

| | | | |
|---|---|---|---|
| DE | 810594 | * | 8/1951 |
| JP | S56-46701 B | | 10/1981 |
| JP | S62-10883 A | | 1/1987 |
| JP | H4-112377 A | | 9/1992 |

* cited by examiner

*Primary Examiner*—Stephen Choi
(74) *Attorney, Agent, or Firm*—Koda & Androlia

(57) ABSTRACT

A safety razor with a plurality of blade members which are covered by a guard plate. The guard plate is provided with a plurality of blade tip guards which are arranged along the blade tip edges of the blade members, and the blade tip edge of at least one of the plurality of blade members is not in contact with the blade tip guards of the guard plate and exposed between the blade tip guards.

3 Claims, 2 Drawing Sheets

SAFETY RAZOR

BACKGROUND OF THE INVENTION

1. Field of the Invention

The present invention relates to a safety razor.

2. Prior Art

One type of existing safety razor includes a plurality of blade tip guards that cover the tip ends of the blade members so that the cutting edges of blade members are exposed between the respective blade tip guards. Such a safety razor is advantageous in that the blade tip guards can soften the contact of the blade members with the skin; and even if the safety razor is moved in the direction parallel to the cutting edges of the blade members during use and the cutting edges slip over the skin in the direction of the length of the cutting edges, there is no danger of injury to the skin.

In such a safety razor, as seen in Japanese Utility Model Application Publication (Kokoku) No. S56-46701, a guard plate which has a plurality of blade tip guards is provided so as to be wrapped around the blade tips of the blade members. Also, Japanese Utility Model Application Laid-Open (Kokai) No. H4-112377 discloses a razor in which a plurality of blade tip guards cover the upper surfaces of the blade tips instead of being wrapped around the blade members.

The blade tip guards disclosed in the above Japanese Utility Model Application Publication (Kokoku) No. S56-46701 are wide, but wide tip guards are generally poor in its whisker cutting efficiency. As a result, therefore, the width of the blade tip guards is designed narrower, so that the blade tip guards are slender.

When whiskers are shaved using conventional razors such as those described above, it often happens that the whiskers contact the immediately adjacent blade tip guards and push these blade tip guards in the lateral direction when the whiskers are actually cut, i. e., when the whiskers are in contact with the cutting edges exposed between the blade tip guards and are thus cut. As a result, after the whiskers have been completely cut, the blade tip guards that have thus been moved return to their original positions by their own elasticity. In such cases, the blade tip guards are moved to the left and right over the cutting edges of the blade members; and the blade tip guards rub against the cutting edges, damage the cutting edges, decreasing the sharpness of the cutting edges.

Such damages to the cutting edges which is resulted from the moving blade tip guards occur for almost the entire length of each of the cutting edges. Accordingly, damage to the cutting edges caused by the blade tip guards causes a greater deterioration in sharpness than the cutting of whiskers by the cutting edges does.

SUMMARY OF THE INVENTION

Accordingly, the object of the present invention is to provide a safety razor in which damages to the cutting edges by blade tip guards are prevented even if the blade tip guards are moved along the cutting edges of the blade members.

The above object is accomplished by a unique structure for a safety razor which includes one or a plurality of blade members, and a guard plate that has a plurality of blade tip guards which extend at right angles (90°) relative to the blade tip edges (or cutting edges) of the blade members and cover the blade tips (or slant surface areas near the cutting edge) of the blade members so that the blade tip edges of the blade members are exposed through the spaces between the respective blade tip guards; and in the present invention the blade tip guards for at least one of the blade members cover the blade tip of such at least one of the blade members with a gap between the blade tip guards and the blade tip edge of such a blade member.

In the structure above, the gap is formed between the blade tip guards and the blade tip edges of at least one of the blade members so that the blade tip guards are not in contact with the blade tip edge of the at least one of the blade members; accordingly, the blade tip edge is prevented from being damaged even if the blade tip guards are moved when the whiskers are being cut.

Furthermore, the object is accomplished by another unique structure for a safety razor that includes three blade members (an upper blade member, middle blade member and a lower blade member) which are superimposed with spacers interposed between the respective blade members; and in the present invention, the blade tip guards over the upper and lower blade members are in contact with the blade tip edges of these blade members but the blade tip guards over the middle blade member are not in contact with the blade tip edge of the middle blade member by way of a gap formed between the blade tip guards and the blade tip edge of the middle blade member.

In this structure, the blade tip guards are in contact with the blade tip edges of the upper and lower blade members; however, for the middle blade member which tends to move by an especially large amount when subjected to laterally oriented pressure from whiskers during use is applied, there is a gap formed between the blade tip edge thereof and the blade tip guards, so that the blade tip guards are not in contact with the blade tip edge of the middle blade member. Accordingly, even if a lateral pressure is applied by the whisker during use, the amount of movement of the blade tip guards on the blade tip edges of the upper and lower blade members can be minimum; and as a result, damages to the blade tip edge of the middle blade member can be prevented, and also damages to the blade tip edges of the upper and lower blade members that can be caused by the movement of the blade tip guards can be also minimum. Thus, the overall deterioration in sharpness of the razor can be minimized.

DETAILED DESCRIPTION OF THE PREFERRED EMBODIMENTS

Embodiments of the present invention will be described with reference to the accompanying drawings.

Figure 1:
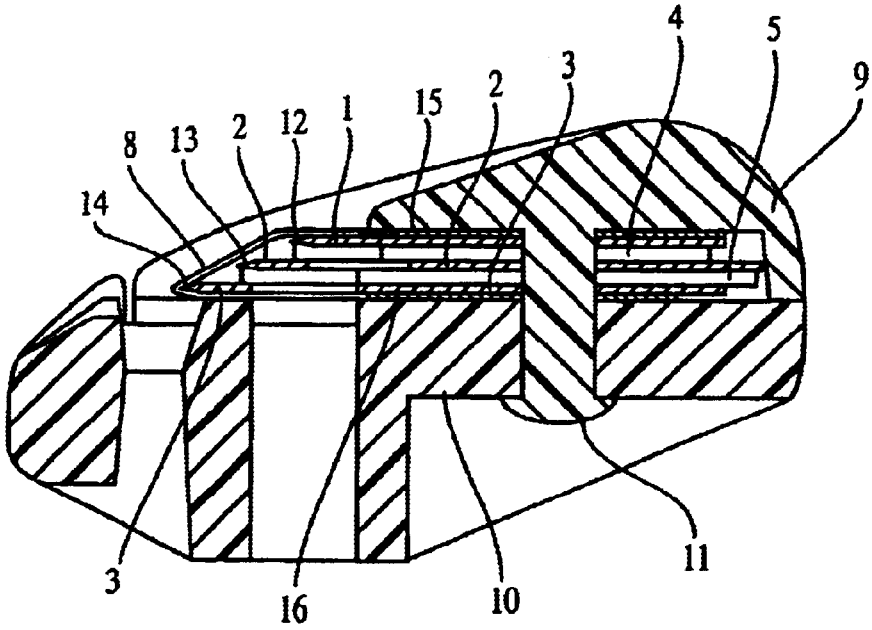
FIG. 1 is a cross-sectional side view of the head portion of a safety razor according to one embodiment of the present invention.

FIG. 1 shows a so-called three-blade safety razor in which three blade members, i. e., an upper blade member 1, a middle blade member 2 and a lower blade member 3, are superimposed. An upper spacer 4 is interposed between the upper blade member 1 and the middle blade member 2, and a lower spacer 5 is interposed between the middle blade member 2 and the lower blade member 3.

Figure 4:
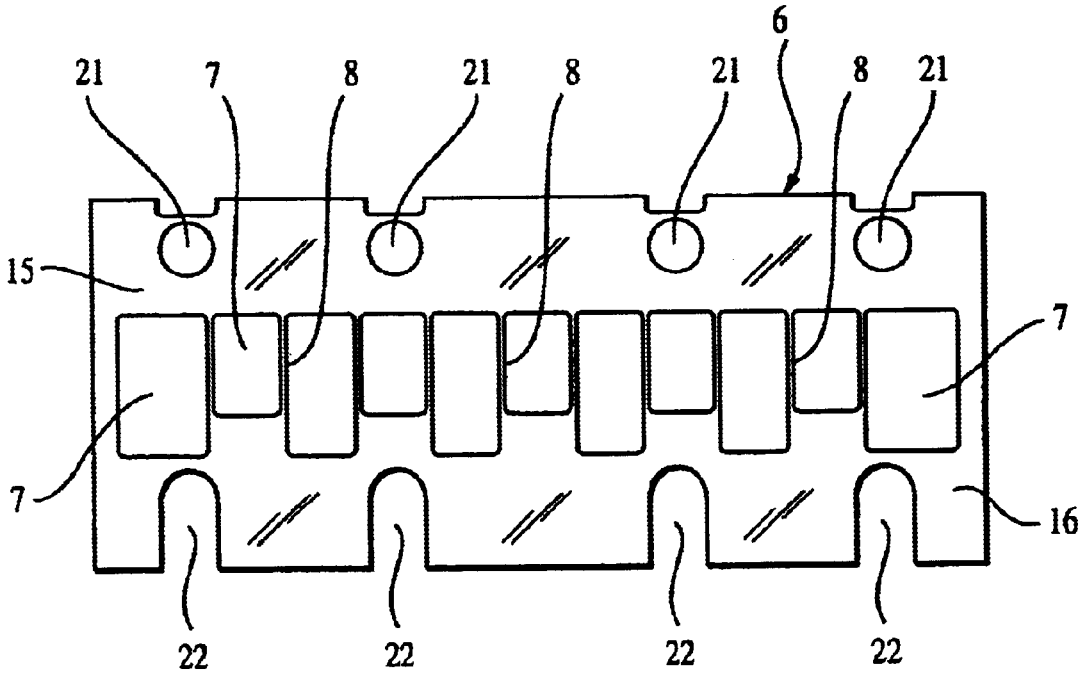
FIG. 4 is a front view of the guard plate used in the safety razor of the present invention.

As seen from FIG. 4, a guard plate 6 is formed in a rectangular shape from a thin metal plate; and a plurality of square holes 7 are opened so as to be lined up adjacent to each other along an imaginal length-wise center line of the guard plate 6. With these holes 7, a plurality of narrow substantially linear blade tip guards 8 are formed between adjacent holes 7, so that these blade tip guards 8 are arranged parallel to each other in the guard plate 6.

As shown in FIG. 1, the guard plate 6 thus structured is bent along a straight line (not shown) extending through the approximate centers of the blade tip guards 8 and is provided so as to cover the blade tip edges of the superimposed blade members 1, 2 and 3. The upper half portion 15 of the bent guard plate 6 is tightly held between the upper blade member 1 and a top plate 9, and the lower half portion 16 of the guard plate 6 is tightly held between the lower blade member 3 and a blade base 10. Furthermore, engaging projections 11 (only one is shown in FIG. 1) which protrude from the back (or bottom) surface of the top plate 9 pass through respective through-holes formed in the upper half portion 15 of the guard plate 6, and further through the upper blade member 1, upper spacer 4, middle blade member 2, lower spacer 5, lower blade member 3, lower half portion 16 of the guard plate, and blade base 10, so that the projections 11 firmly fasten these elements together in a superimposed fashion.

The through-holes formed in the guard plate 6 so that the engaging projections 11 pass therethrough consist of, as seen from FIG. 4, round holes 21 formed in the upper half portion 15 of the guard plate and U-shaped recessed parts 22 formed in the lower half portion 16 of the guard plate 6. The U-shaped recessed parts 22 formed in the lower half portion 16 of the guard plate 6 are not round holes. Such U-shaped recessed parts 22 are formed so as to compensate for any discrepancies in the position of the bending line of the guard plate 6 that arise during the manufacturing process and also to compensate for other dimensional errors arising in the manufacturing process.

As shown in FIG. 1, the guard plate 6 is provided so that the blade tip guards 8 of the guard plate 6 that cover the blade tip edges of the three blade members 1, 2 and 3 contact the blade tip edge 12 of the upper blade member 1 and blade tip edge 14 of the lower blade member 3; however, a gap is formed between the blade tip guards 8 and the blade tip edge 13 of the middle blade member 2, so that the blade tip guards 8 are not in contact with blade tip edge 13 of the middle blade member 2.

The blade tip edge 12 of the upper blade member 1 and the blade tip guards 8 are in contact with each other with a fairly large amount of pressure and not in a mere light contact; and the blade tip edge 14 of the lower blade member 3 and the blade tip guards 8 are also in contact with a fairly large amount of pressure and not in a mere light contact. Thus, the frictional force generated by such contact with a pressure is a fairly large force; and even if a pressure in the lateral direction (in the direction of the blade tip edges of the blade members) is received from the whiskers during use, the amount of movement of the blade tip guards 8 in the areas contacting with the whiskers is minimum. Accordingly, the amount of damage on the blade tip edge 12 of the upper blade member 1 and on the blade tip edge 14 of the lower blade member 3 as a result of the left-right movement of the blade tip guards 8 can be insignificant, and the deterioration in sharpness of these blade tip edges is minimum.

In contrast, a gap is formed between the blade tip edge 13 of the middle blade member 2 and the blade tip guards 8, and these elements are not in contact. Accordingly, even if the blade tip guards 8 are subjected to pressure in the lateral direction from the whiskers during use so that these blade tip guards 8 are moved in the left-right direction, there is no danger that the blade tip edge 13 of the middle blade member 2 is damaged by the blade tip guards 8. As a result, loss of sharpness of the blade tip edge 13 of the middle blade member 2 due to contact with the blade tip guards 8 will not occur.

As seen from the above, in the three-blade safety razor shown in FIG. 1, only the blade tip edge 13 of the middle blade member 2 is not in contact with the blade tip guards 8; and the blade tip edge 12 of the upper blade member 1 and the blade tip edge 14 of the lower blade member 3 are both in contact with the blade tip guards 8. However, as described above, since the amount of damage to the blade tip edge 12 of the upper blade member 1 and the blade tip edge 14 of the lower blade member 3 as a result of the movement of the blade tip guards 8 is relatively small, the deterioration in sharpness is slight, and the effect of the present invention can be sufficiently achieved.

The effect of the present invention can be heightened even further if the blade tip edges of two blade members or the blade tip edges of all of the three blade members are not in contact with the blade tip guards.

So as to design that the blade tip edges of two blade members are not in contact with the blade tip guards 8, the blade tip guards 8 extending along the upper surface of the upper blade member 1 are not bent along the blade tip edge 12 of the upper blade member 1 but are horizontally extended to a point forward of the blade tip edge 12 of the upper blade member 1 and then bent obliquely downward with a gap left between the blade tip guards 8 and the blade tip edge 12 of the upper blade member 1. As a result, since the blade tip edge 12 of the upper blade member 1 is not in contact with the blade tip guards 8, the blade tip edge 12 of the upper blade member 1 is prevented from a damage that would be caused by the left-right movement of the blade tip guards 8.

Furthermore, the blade tip guards 8 extending along the under surface of the blade tip edge 14 of the lower blade member 3 can be bent at a point forward of the blade tip edge 14 instead of being bent along the blade tip edge 14 so that the blade tip guards 8 are not in contact with the blade tip edge 14 of the lower blade member 3. As a result, the blade tip edge 14 of the lower blade member 3 is prevented from a damage that would be caused by the left-right movement of the blade tip guards 8.

With the structure above, the blade tip edges of all three blade members 1, 2 and 3 are prevented from contacting the blade tip guards 8.

Figure 2:
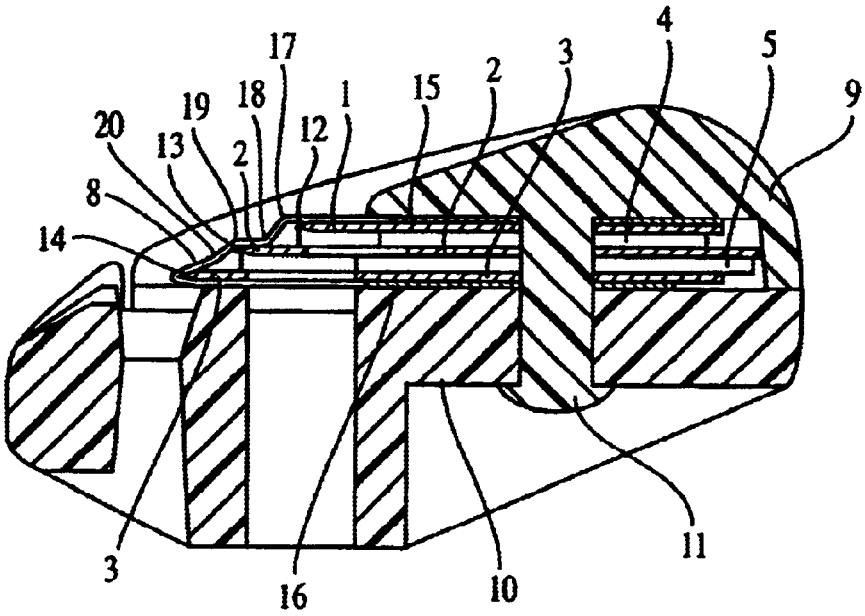
FIG. 2 is a cross-sectional side view of the head portion of a safety razor according to another embodiment of the present invention.
Figure 3:
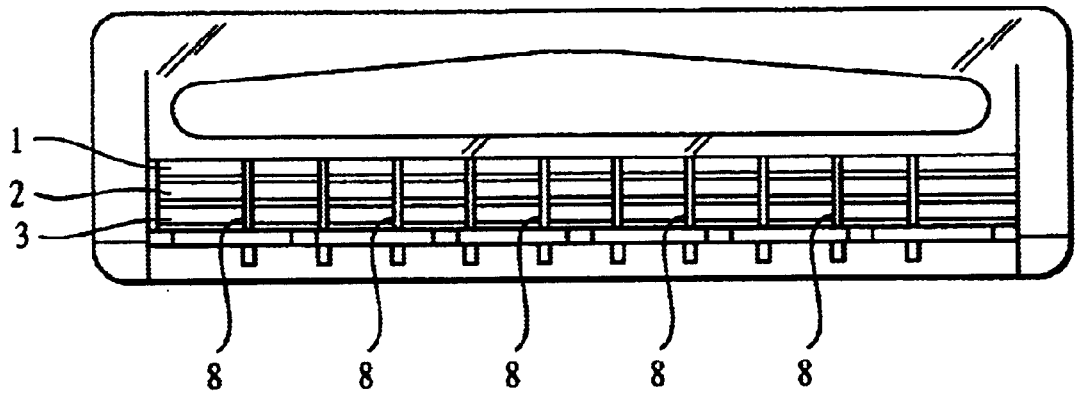
FIG. 3 is a top view showing the cutting blades in the safety razor according to the present invention.

FIG. 2 shows another embodiment of the present invention which provides an enhanced effect with a safety razor.

The structure shown in FIG. 2 is substantially the same as that of FIG. 1. In other words, the upper blade member 1, upper spacer 4, middle blade member 2, lower spacer 5 and lower blade member 3 are superimposed and held between the top plate 9 and the blade base 10; and they are fastened together by engaging projections 11 formed on the top plate 9. The guard plate 6 formed in a rectangular shape from a thin metal plate is provided so as to cover the blade tip edges of the three superimposed blade members 1, 2 and 3. The guard plate 6 is bent, and the upper half portion 15 of the bent guard plate 6 is held between the upper blade member 1 and the top plate 9, and the lower half portion 16 of the guard plate 6 is held between the lower blade member 3 and the blade base 10.

Though in the embodiment of FIG. 1 the blade tip guards 8 wrap around the blade tips of the blade members, in the embodiment shown in FIG. 2, the guard plate 6 is further bent in substantially a crank-shape so as to form bent portions in the blade tip guards 8 and fitted over the blade tips of the superimposed blade members.

More specifically, the guard plate 6 is shaped so that the blade tip guards 8 which extend along the upper surface of the blade tip of the upper blade member 1 are bent obliquely downward at a point somewhat forward of the blade tip edge 12 of the upper blade member 1, so that a first outward bent portion 17 is formed. As a result, a gap is formed between the blade tip edge 12 of the upper blade member 1 and the blade tip guards 8 so that the blade tip edge 12 and the blade tip guards 8 are not in contact.

The blade tip guards 8 which are bent at the first outward bent portion 17 are further bent inwardly at a position where the blade tip guards 8 contact the upper surface of the middle blade member 2, thus forming a first inward bent portion 18.

Furthermore, the blade tip guards 8 are bent at the first inward bent portion 18 so that the blade tip guards 8 are more or less horizontal and then bent obliquely downward at a point forward of the blade tip edge 13 of the middle blade member 2, so that a second outward bent portion 19 is formed. As a result, a gap is formed between the blade tip edge 13 of the middle blade member 2 and the blade tip guards 8 so that the blade tip edge 13 and the blade tip guards 8 are not in contact.

The blade tip guards 8 which are bent at the second outward bent portion 19 are further bent at a position where the blade tip guards 8 contact the upper surface of the lower blade member 3, so that a second inward bent portion 20 is formed.

The blade tip guards 8 which extend forward from the second inward bent portion 20 are further bent so as to wrap around the blade tip edge 14 of the lower blade member 3 and come into contact with this blade tip edge 14 and then extend between the under surface of the lower blade member 3 and the blade base 10. However, the blade tip guards 8 which wrap around the blade tip edge 14 of the lower blade member 3 are not necessarily in contact with the blade tip edge 14 of the lower blade member 3; and it is possible to form a gap between the blade tip edge 14 of the lower blade member 3 and the blade tip guards 8 so that the blade tip guards 8 cover the blade tip edge 14 and these elements are not in contact. With this structure, all the blade tip edges of the three blade members 1, 2 and 3 are not in contact with the blade tip guards 8.

In the above embodiments, the present invention is described with reference to a three-blade safety razor. However, the present invention is not limited to a three-blade safety razor; and it goes without saying that the invention can be applied to a safety razor that comprises a single blade member or a safety razor that includes a pair of blade members.

For a single-blade safety razor, a guard plate is bent at a position slightly forward of the blade member so that the blade tip guards of the guard plate wrap around the blade tip edge of the blade member with a gap between the bent portion (blade tip guards) of the guard plate and the blade tip edge, thus preventing a contact between the blade tip guards and the blade tip edge of the blade member.

As to a two-blade safety razor, such a two-blade safety razor has a structure without the middle blade member 2 and one of the spacers (4 or 5) shown in FIGS. 1 and 2. Thus, it can be designed so that the blade tip edge of only one of the blade members is not in contact with the blade tip guards or the blade tip edges of both of the blade members are not in contact with the blade tip guards. In these structures, the blade tip guards covering the blade tips are simply bent in a somewhat circular arc shape so that a contact with the blade tip edges is prevented as shown in FIG. 1, or bent portions are formed as shown in FIG. 2.

It should be noted that in the present invention the means in which the blade tip guards cover the blade tip(s) is not limited to the structure in which the guard plate is, as shown in the accompanying drawings, folded into two and the blade tip guards thereof are wrapped around the blade member(s), and such a means further includes the structure in which the blade tip guards are not wrapped around the blade member (s) but covered on the upper surface(s) of the blade tip(s) as disclosed in the Japanese Utility Model Application Laid-Open (Kokai) No. H4-112377 which is referred to above as a prior art.

What is claimed is:

1. A safety razor comprising:

an upper blade member, a middle blade member and a lower blade member which are superimposed, a space provided between said respective blade members, and blade tip guards crossing blade tip edges of said blade members;

wherein a blade tip edge of said upper blade member and a blade tip edge of said lower blade member are in contact with said blade tip guards, and a blade tip edge of said middle blade member is not in contact with a front of said blade tip guards by way of a gap formed between a front of said blade tip edge of said middle blade member and said blade tip guards.

2. A safety razor comprising:

a first blade member, a second blade member and a third blade member which are superimposed one on the other, each of said first blade member, second blade member and third blade member having a blade tip edge;

a first spacer interposed between said first blade member and said second blade member;

a second spacer interposed between said second blade member and said third blade member;

a guard plate formed with a plurality of blade tip guards and provided so as to cover blade tip edges of said first blade member, second blade member and third blade member; and said blade tip guards are in contact with said blade tip edge of said first blade member and said blade tip edge of said third blade member, and said blade tip guards are not in contact with said front edge of said blade tip edge of said second blade member.

3. A safety razor according to any one of claims 1 and 2, wherein said blade tip guards wrap around said front of said blade tip edge of at least one blade member.

* * * * *